US006988702B2

(12) United States Patent
Schulz

(10) Patent No.: US 6,988,702 B2
(45) Date of Patent: Jan. 24, 2006

(54) HOLDING DEVICE

(76) Inventor: Rainer Schulz, Elektrastrasse 12a, 81925 Muenchen (DE)

( * ) Notice: Subject to any disclaimer, the term of this patent is extended or adjusted under 35 U.S.C. 154(b) by 31 days.

(21) Appl. No.: 10/362,311

(22) PCT Filed: Aug. 30, 2001

(86) PCT No.: PCT/EP01/10039

§ 371 (c)(1),
(2), (4) Date: Jun. 30, 2003

(87) PCT Pub. No.: WO02/24041

PCT Pub. Date: Mar. 28, 2002

(65) Prior Publication Data

US 2004/0099782 A1 May 27, 2004

(30) Foreign Application Priority Data

Sep. 22, 2000 (DE) ..... 200 16 472 U
Mar. 5, 2001 (DE) ..... 201 03 790 U
Mar. 22, 2001 (DE) ..... 201 05 005 U

(51) Int. Cl.
*F16M 13/00* (2006.01)

(52) U.S. Cl. ..... 248/525; 248/523

(58) Field of Classification Search ..... 248/519, 248/523, 524, 527; 47/40.5; D11/130.1
See application file for complete search history.

(56) References Cited

U.S. PATENT DOCUMENTS

| | | | | |
|---|---|---|---|---|
| 2,679,994 | A * | 6/1954 | Mellen | 47/40.5 |
| 3,301,512 | A | 1/1967 | Nyberg | |
| 5,114,113 | A * | 5/1992 | Krinner | 248/525 |
| 5,797,579 | A * | 8/1998 | Krinner | 248/523 |
| D444,412 | S * | 7/2001 | Krinner et al. | D11/130.1 |

FOREIGN PATENT DOCUMENTS

| | | | |
|---|---|---|---|
| DE | 94 20 727 | | 4/1996 |
| DE | 29707643 | U1 * | 7/1997 |
| DE | 29919365 | U1 * | 2/2000 |
| DE | 10000879 | A1 * | 7/2001 |

* cited by examiner

*Primary Examiner*—Gwendolyn Baxter
(74) *Attorney, Agent, or Firm*—Jordan and Hamburg LLP

(57) ABSTRACT

The invention relates to an improved holding device for receiving pole-shaped objects, especially trees, christmas trees for example. The inventive device has a plurality of holding elements (4–4*c*; 104–104*c*), each having a swivel axis (7–7*c*; 114–114*c*) associated thereto. The holding elements and swivel axes can be moved towards and away from the axis of symmetry and/or central axis (115), and the holding elements (4–4*c*; 104–104*c*) and the swivel axes (7–7*c*; 114–114*c*) associated thereto can be moved by a clamping device (2; 102), against the force of a spring device (10; 13).

22 Claims, 9 Drawing Sheets

HOLDING DEVICE

Figure 1:
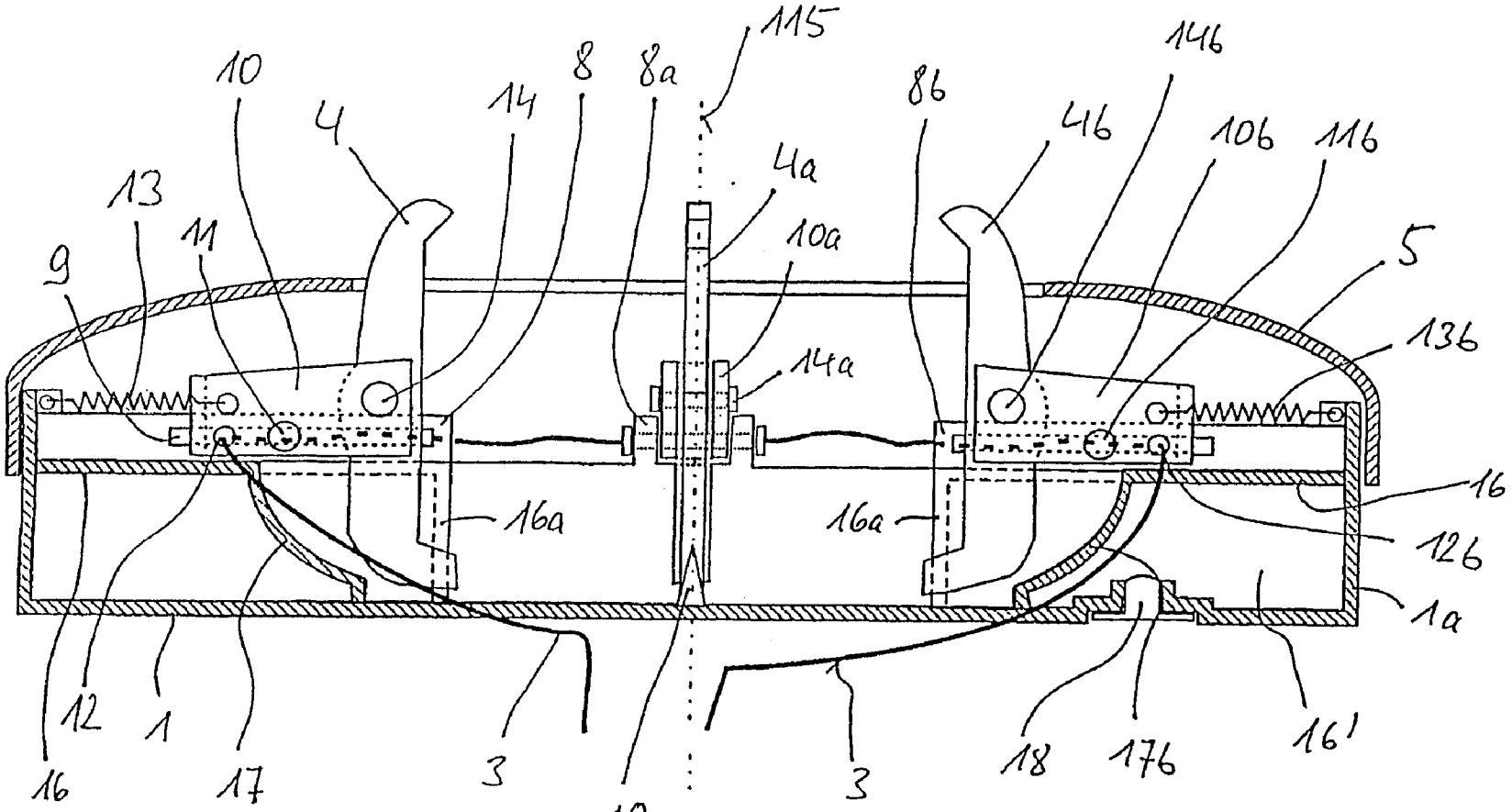

The invention relates to a holding device for holding post-shaped objects, particularly trees and Christmas trees.

Christmas tree stands in various versions are known in practice. Stands are offered, which consist of a footplate, on which a pipe is fastened vertically and in which the Christmas tree is fastened by means of several horizontally disposed tommy screws. The setting up of a tree by means of such a stand harbors many problems as a rule. Two persons are required for setting up and aligning, the tree stumps usually have to be made to fit, the tommy screws offer only small surfaces for engagement by the fingers and therefore can be turned only with difficulty, and only a slight water supply, if any, is ensured.

Stands are also known, the seating tube of which has an overdimensioned diameter, in which the tree is placed approximately centrally and then, by means of various wedges, which are driven between the edge of the seating tube and the tree, is wedged fast. Here also, it is difficult here also for a single person to align the tree.

Furthermore, a stand is known, for which the trunk of the tree, which is to be fastened, is guided in a sleeve, which is provided with slots, a wedge-shaped displacement body being screwed in the form of a connection nut onto the outer periphery of the sleeve and, with its wedge-shaped displacement profile, radially disposed clamping jaws are forced in the direction of the tree trunk. The tree trunk, which is guided in the sleeve, is finally clamped and fixed by the clamping jaws, which move radially inward. With this tree stand also, it is a disadvantage that, when the cross section of the tree trunk deviates from the circular, the contact between the tree trunk and the clamping jaws is non-uniform, so that, on the one hand, the tree trunk is fastened inadequately, and, on the other, its alignment is not completely perpendicular.

Furthermore, Christmas tree stands are known with a seating part for the trunk, which is disposed at the base plate, and several holding elements, which are disposed about a symmetrical axis and are provided above the seating part, so that they can be swiveled in planes independently of one another, individually between a releasing position and a holding position. In the holding position, the holding elements can be placed with a contacting area under pressure against the trunk of the tree. The holding device has only one clamping device, which engages over a force transfer element simultaneously at all holding elements with an unequal action of forces and moves the holding elements into their holding position.

Although such a Christmas tree stand has entirely proven its value in practice, it also has disadvantages. For example, an appreciable manual force, in, moreover, a very bent posture is required for such a Christmas tree stand in order, on the one hand, to hold the tree in a straight position, and, on the other, to actuate a clamping device.

A Christmas tree stand is known, which is produced by a cumbersome and expensive casting method and is constructed in an inclined plane as a pot with three webs, which are firmly connected at intervals of 120° and a slope of 25°. The clamping wedges, which are provided with appropriate grooves, are disposed movably at the webs in such a manner, that the tree, which has been inserted centrally, presses on a plate, which is connected with the clamping wedges, and, by these means, causes the clamping wedges to contact the tree and fasten it. A tree, so fastened, can be removed only with difficulty.

It is an object of the present invention to develop a generic holding device further in such a manner that Christmas trees, up to a height, for example, of 3.5 m and more with thick and thin stumps and smooth or irregular surfaces at the stumps can be fastened perpendicularly with little expenditure of force in a pre-selected position at the lowest possible cost.

Pursuant to the invention, provisions are made that the actual holding elements, which can be bought into contact with the tree stump and preferably are constructed rocker-like and pivotably, overall can be shifted towards or away from the tree trunk. For this purpose, the holding elements can be mounted on sliding or rolling elements, which can be adjusted in the direction of or away from the tree stump, and/or on pivot levers, which can be tilted in the direction of or away from the tree stump.

Furthermore, in a particularly preferred embodiment, provisions are made so that the adjustment motion into the fixing position, that is, towards the tree stump, can be carried out so that the rocker-shaped or double lever-shaped holding elements not only carry out a shifting motion with a radial component towards the tree stump, but also, above all, also with a downwards directed component. As a result, it is ensured that the tree stump is placed even more firmly into its stand position during the fixing motion of the holding device and especially is pushed more firmly and deeper into an arbor, which preferably is provided there. This also serves to increase the safety and stability.

Preferably, therefore, the construction is such that one or more jointly acting force-transfer elements initially moves or move essentially independently of one another but, nevertheless, simultaneously in the direction of the stump of the Christmas tree, which is to be fixed. In other words, the holding elements initially contact the outer shape and adjustment position of the stump of the Christmas tree appropriately at its periphery and, moreover, not in a fixed sequence. In this position, it is utterly possible to check whether the tree, which is to be fixed, is standing perpendicularly or if it still has to be aligned.

Upon further actuation of the force transfer elements, individual holding elements will strike stumps of branches or very noncircular deformations or bulges of the tree trunk, irrespective of whether the trunk has been inserted centrally. The forces, required for the ultimate locking, are applied over all holding elements at the tree stump in such a manner, that they equalize one another and prevent the trunk being forced into an unwanted position.

The stand, which is to be produced, may consist, for example, of plastic and can therefore be manufactured relatively inexpensively. It can also be sealed towards the outside, so that it is possible to do without a container, into which it is inserted, and to fill the entire interior with water for supplying the tree. Furthermore, due to the penetration of the liquid, especially of water, into a special cavity system, the required weight of the stand device as a whole can be increased. Since the filling need take place only at the place of use, the advantage of a lower transporting weight arises.

Because of the special embodiment of the tensioning device, a longer foot-operated lever may be provided, which can be actuated with the expenditure of less force than can the previously known foot-operated levers. As a result and due to the individual placement of the holding elements, required by the periphery and outer configuration of the tree stump, an individual person can very easily and comfortably bring the tree into an upright position and set it up perpendicularly on a central axis or an axis of symmetry.

The invention is described in the following by means of drawings, in which

Figure 2:
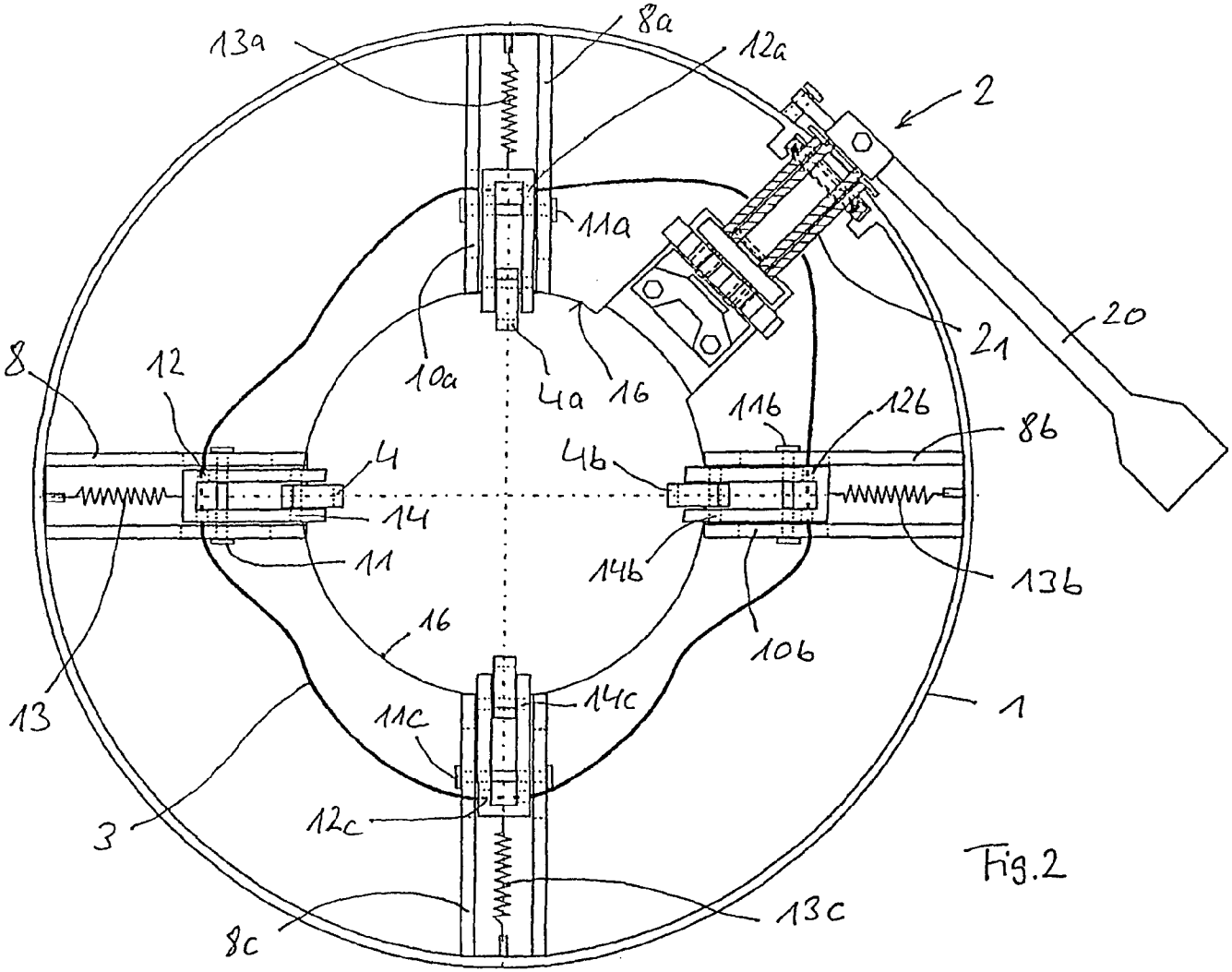
Figure 3:
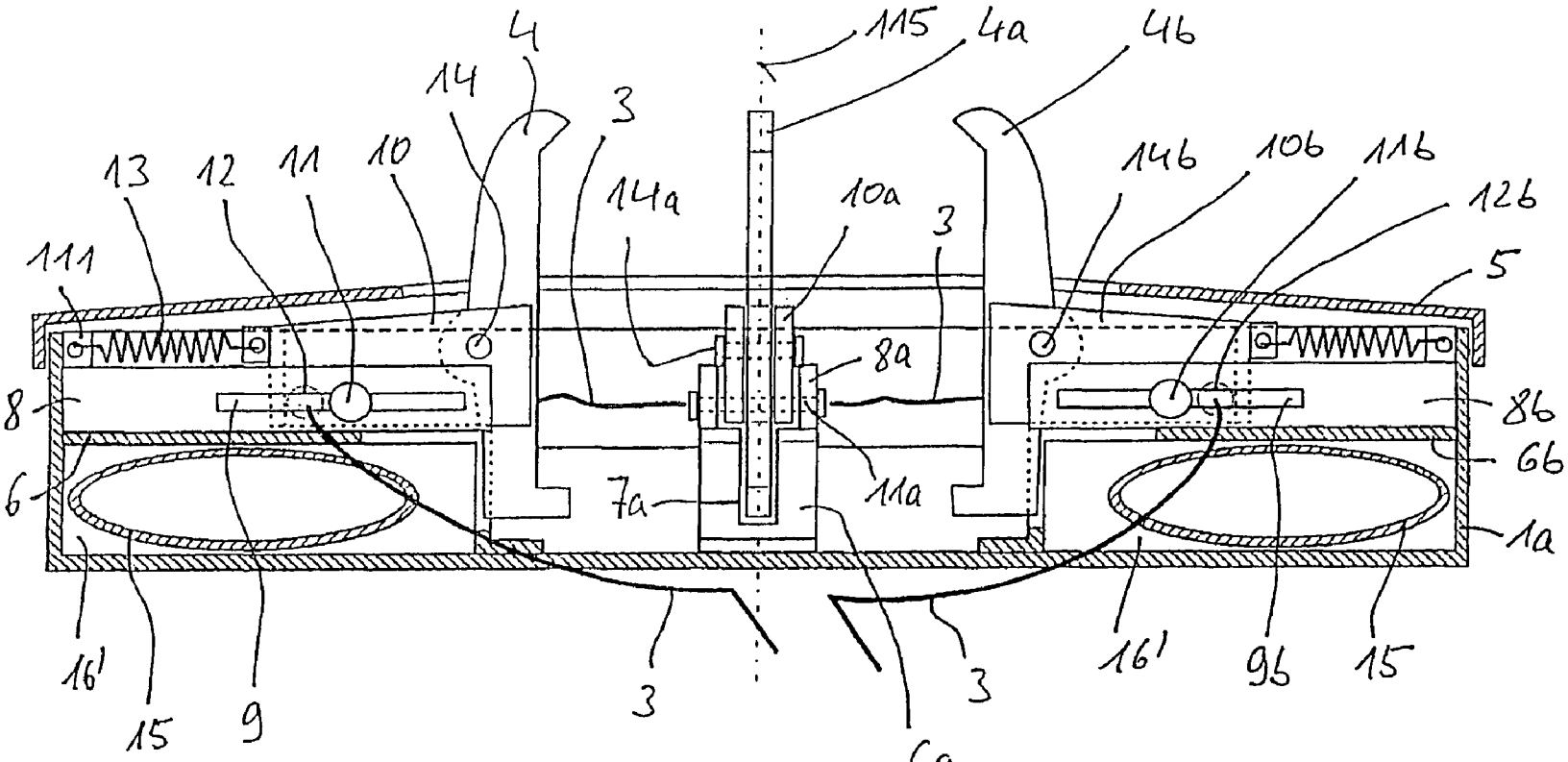
Figure 5:
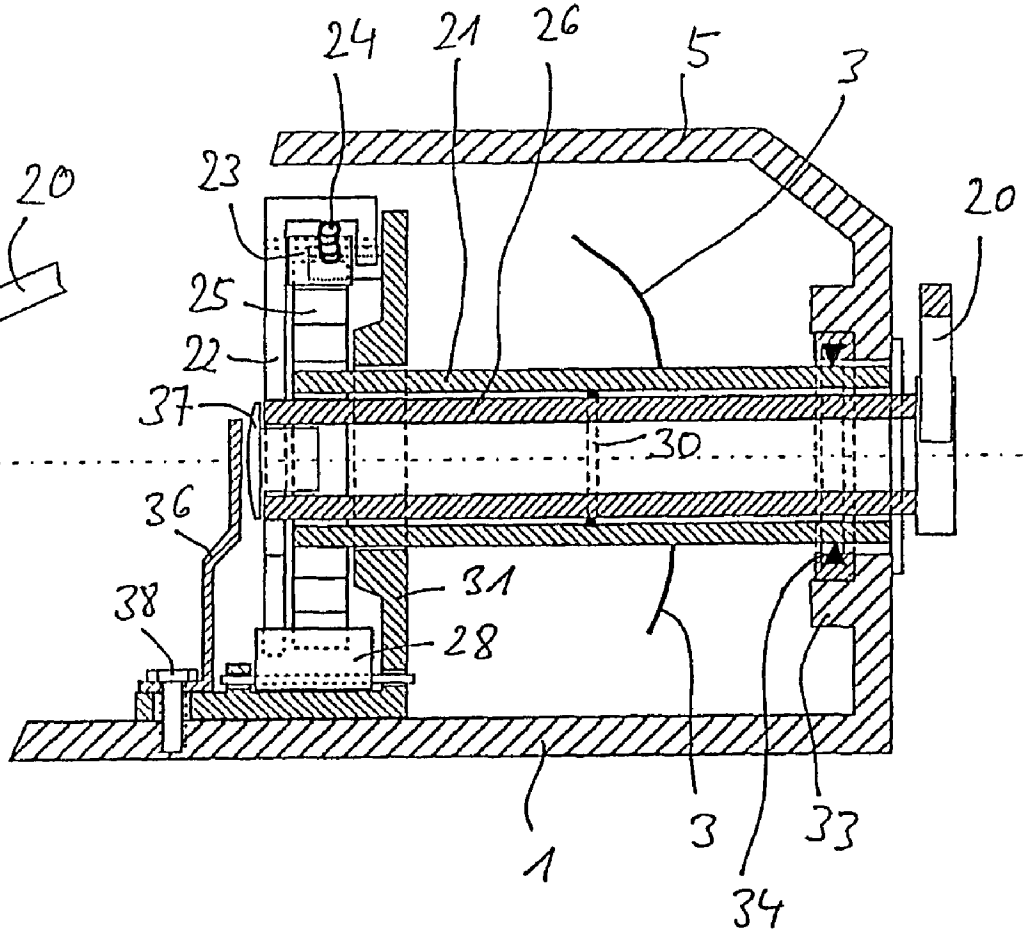
Figure 4:
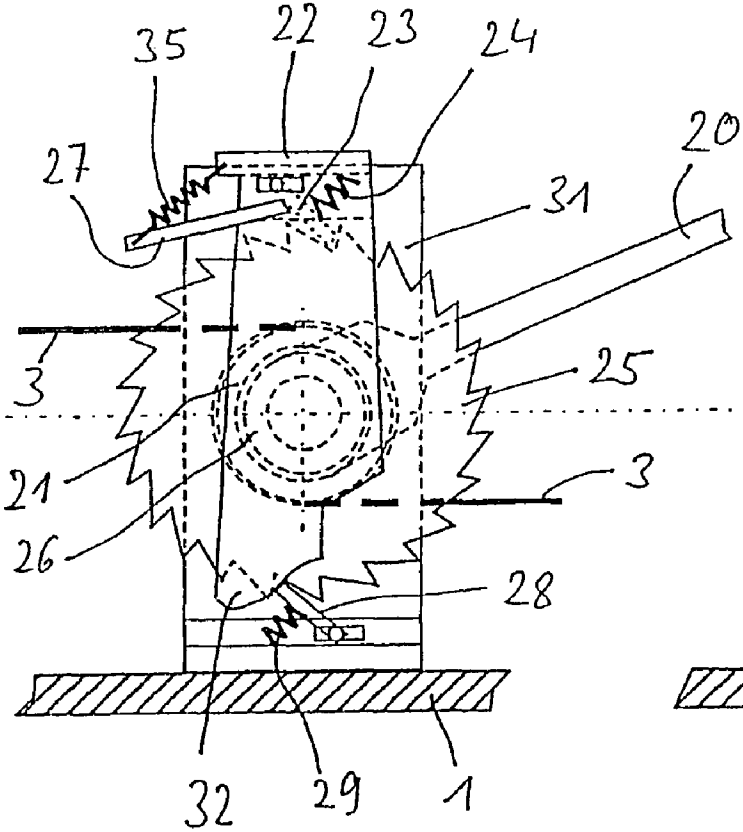
Figure 6:
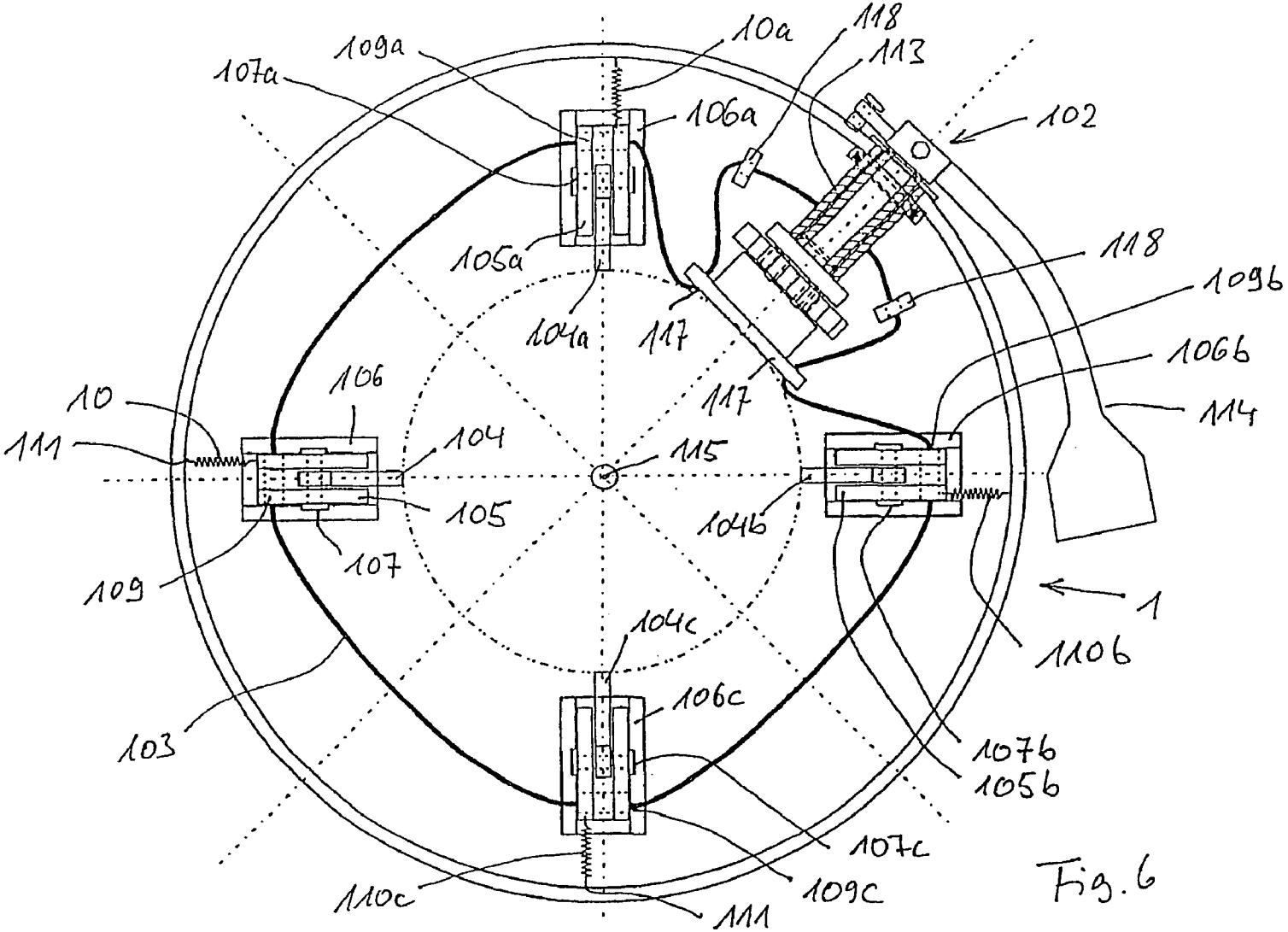
Figure 7:
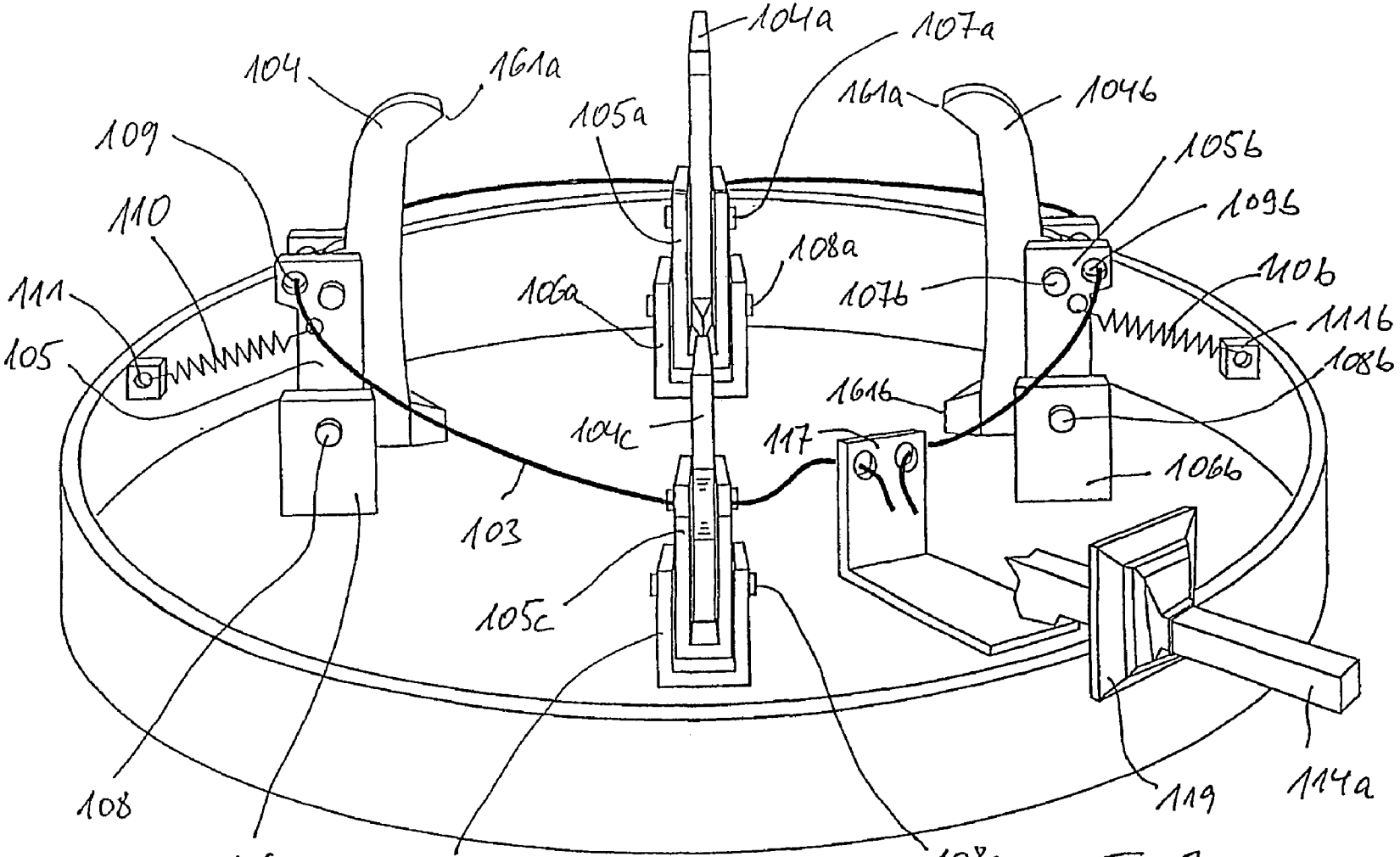
Figure 9:
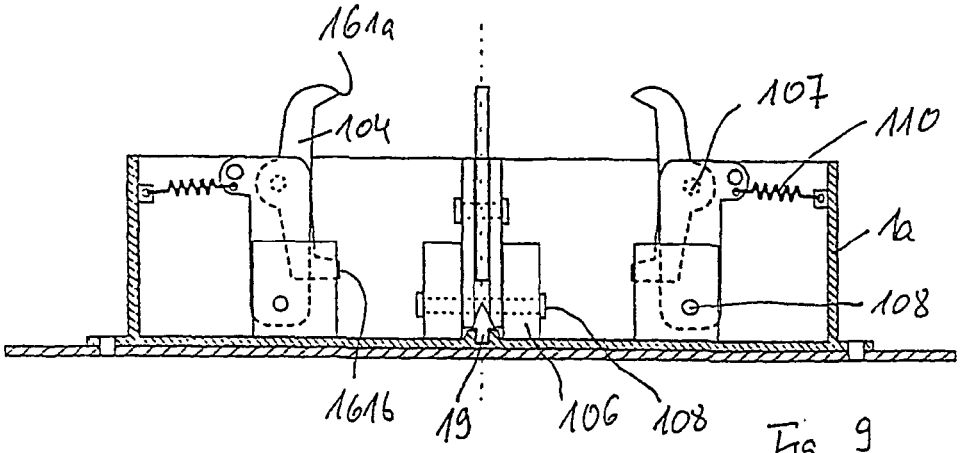
Figure 8:
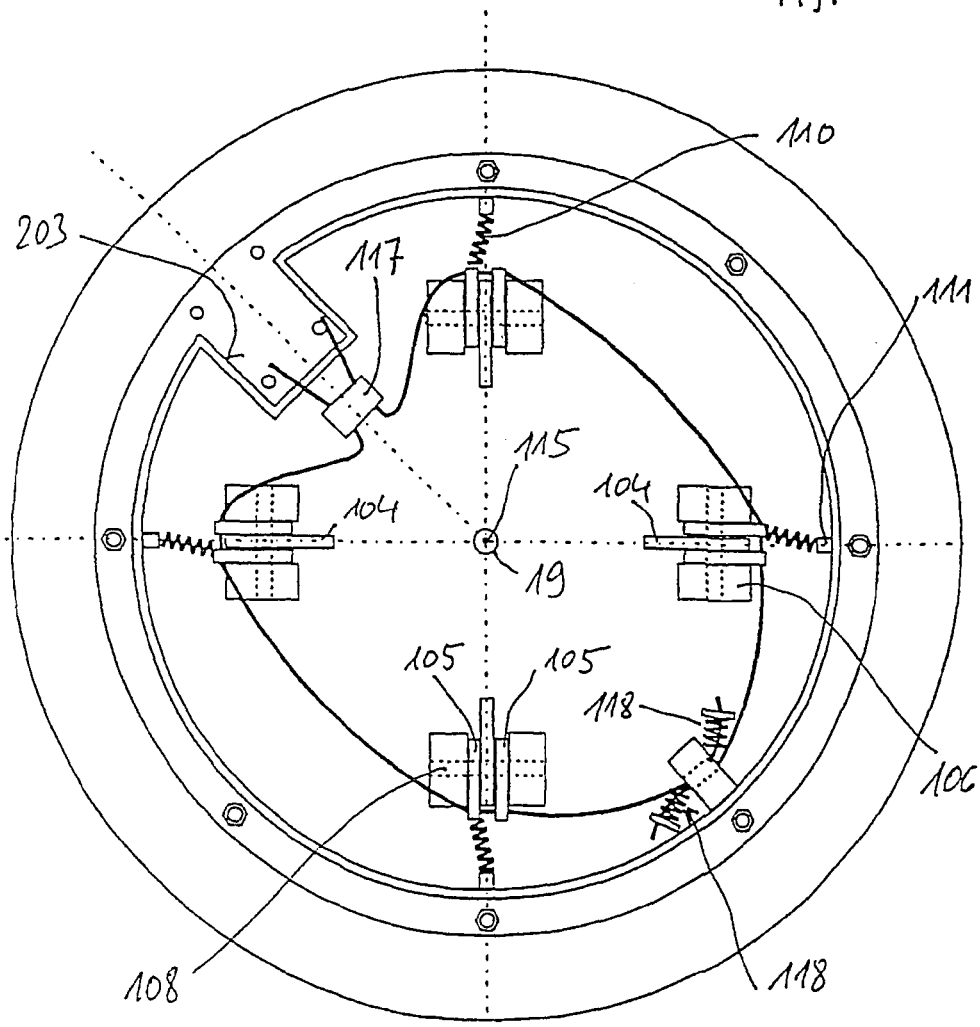
Figure 10:
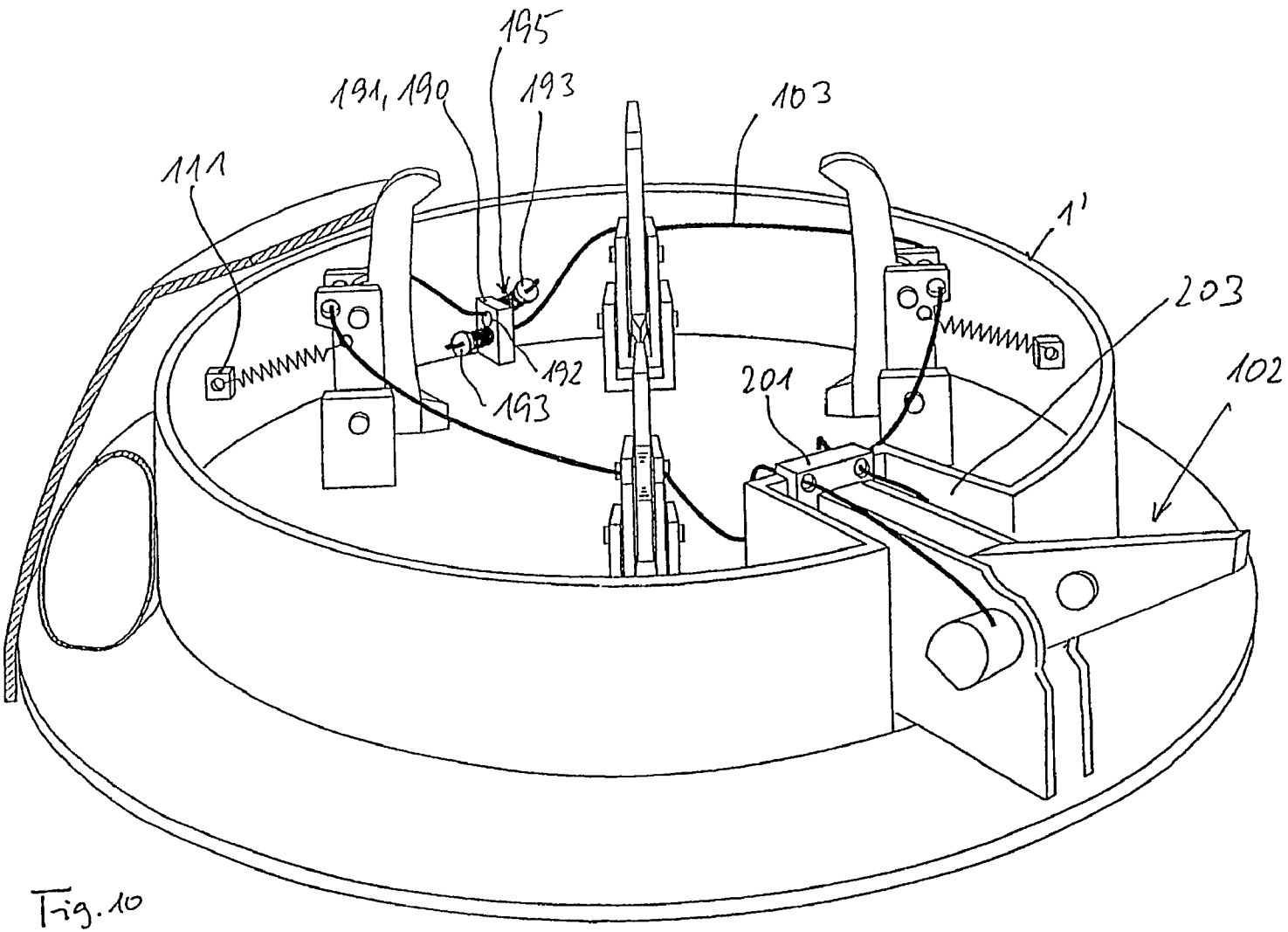
Figure 11:
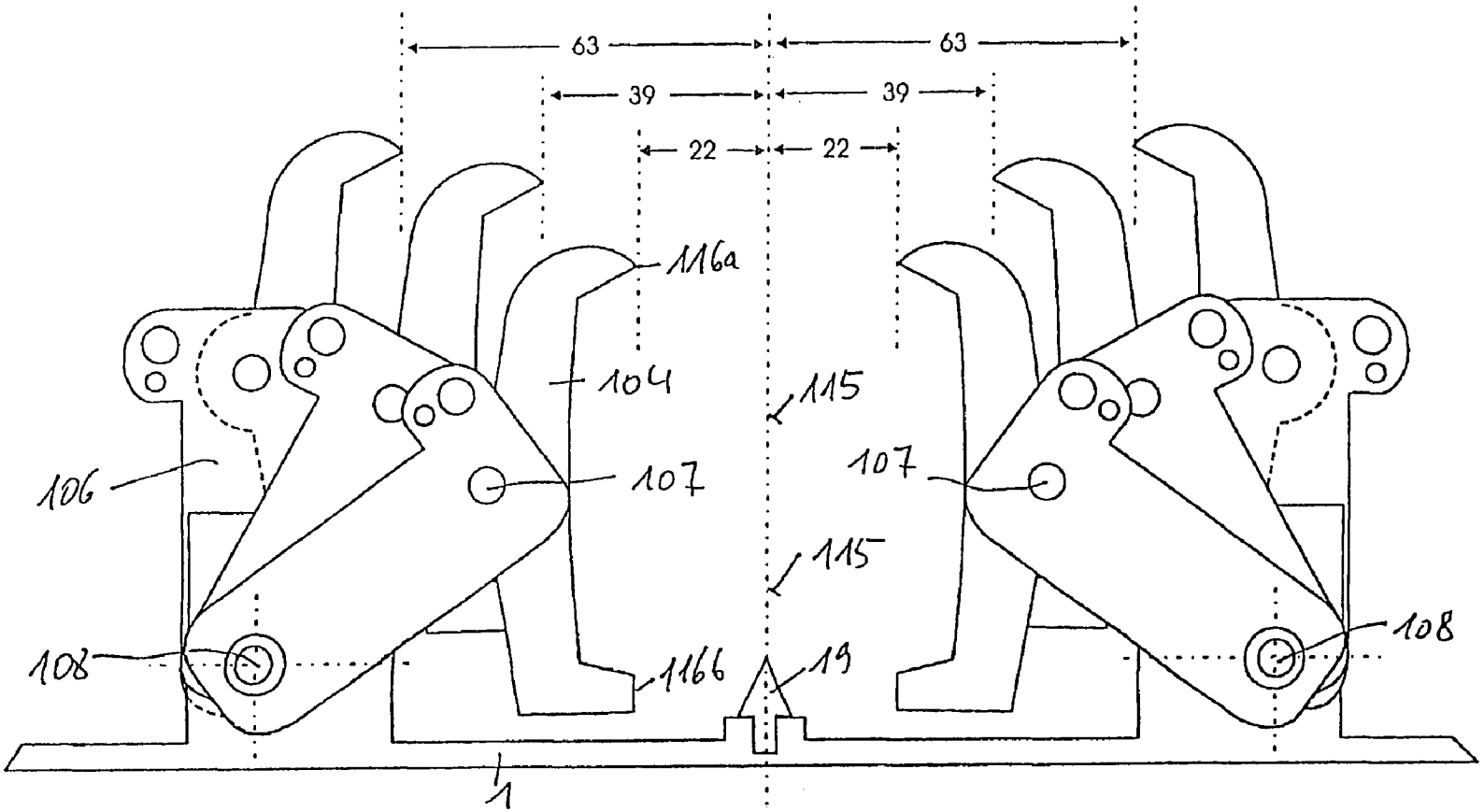

FIG. 1 shows a diagrammatic, vertical cross-sectional view of a first embodiment of a Christmas tree stand in section, FIG. 2 shows a diagrammatic, plan view of the embodiment of FIG. 1, FIG. 3 shows a diagrammatic, vertical cross-sectional view with a second embodiment of the Christmas tree stand in section, FIG. 4 shows a diagrammatic front view of the tensioning device, FIG. 5 shows a diagrammatic transverse side view of the tensioning device, shown in FIG. 4, in section, FIG. 6 shows a further embodiment in plan view, FIG. 7 shows a prospective representation of the example of FIG. 6, FIG. 8 shows a plan view of a further modified example, FIG. 9 shows a cross-sectional representation through the example of FIG. 8, FIG. 10 shows a diagrammatic, perspective representation of the example of FIGS. 8 and 9 and FIG. 11 shows a diagrammatic, cross-sectional representation to explain the adjustment principle for the example of the FIGS. 7 to 10.

In the following, reference is made, to begin with, to the example of FIGS. 1 and 2.

In FIGS. 1 and 2, a holding device with a base plate 1 is shown, which is connected or can be connected over the whole periphery with a wall, which forms a container. A plate 16 is provided at an angle of about 90° to an imaginary axis of symmetry or central axis 115. It is connected, on the one hand, with the preferably cylindrical wall 1*a* (which represents an outer wall) and, on the other, over a boundary wall 16*a*, which extends over large stretches cylindrically and, with that, in the example shown, essentially perpendicularly to the base plate as well as to the cover plate 16, with the base plate 1. As a result, a ring-shaped, peripheral tunnel 16' is formed in plan view and can be filled with a weight-adding material, such as water or sand.

Due to the inner, essentially cylindrical boundary wall 16*a*, a vessel-like space for inserting an object, which is to be fastened, such as the stump of a Christmas tree, is formed in the direction of the central axis or axis of symmetry 115. On the upper surface of the tunnel 16', which is disposed approximately parallel to the base plate 1, several slide rails 8, 8*a*, 8*b*, 8*c*, which may be formed, for example, in the form of U-shaped profiles, are provided in a circle about the imaginary central axis or axis of symmetry 115. These slide rails therefore are disposed on the cover plate 16 of the tunnel arrangement 16' or connected therewith, so that sliding elements 10, 10*a*, 10*b*, 10*c* can be adjusted by means of a sliding process at or in these slide rails.

At the sliding or carriage elements 10, 10*a*, 10*b*, 10*c*, preferably at their ends facing the central axis or axis of symmetry, bearing bolts 14, 14*a*, 14*b*, 14*c* are formed, about which vertical, pivotably mounted holding elements 4, 4*a*, 4*b*, 4*c* are rotatably suspended. Moreover, the bearing bolts 14 to 14*c* form an at least approximately horizontal pivot axis or all have such an approximately horizontal pivot axis.

Furthermore, a tensioning device 2 is provided, to which the ends of one or more flexible force-transfer elements 3 are fastened, for example, in the form of a wire rope. These force-transfer elements 3 are placed through guiding boreholes 12, 12*a*, 12*b* and 12*c* in the gliding or sliding elements 10, 10*a*, 10*b*, 10*c*, so that, when the clamping device 2 is actuated—as a result of which the force-transfer elements 3, which preferably are in the form of a wire rope, are wound up in the sense of a shortening of the clamping device 2, the sliding or carriage elements 10 to 10*c* finally are shifted in the direction toward the vertical central axis or axis of symmetry 115, because the force-transfer elements 3, which are installed approximately loop-shaped in plan view, are pulled together by actuating the tensioning device. At the same time, the force-transfer elements, which are preferably formed in the form of a wire rope, protrude laterally into the sliding or carriage elements, in each case through the aforementioned guiding boreholes 12 to 12*c*, the force-transfer elements 3 then also extending through sliding slots 9 to 9*c*, which are introduced laterally in the slide rails 8 to 8*c*, and, with that, the adjusting motion of the sliding elements or sliding carriage can be carried out without problems.

During such an adjusting movement of the sliding elements 10 to 10*c*, the holding elements 4 to 4*c*, which are held at them and can be swiveled about their horizontal axes, are shifted towards the central axis or axis of symmetry 115 of the container 1*a*. At the same time, the holding elements 4 to 4*c* are initially placed in contact with the outer periphery of the tree stump or tree, placed in the free space of the vessel 1, until they then fix the tree or tree stump initially slightly with their points and/or contacting surfaces and/or contacting areas formed at both ends above and below their mounting 14 to 14*c*. As a result, a subsequent alignment of the tree is still possible. During a further tensioning motion of the force-transfer element 3, the tips or supporting sections, offset to their tilting or rocker axis, press increasingly onto the bark of the tree stump, until the contacting sections possibly penetrate at least slightly into the tree stump and do so, moreover, independently of whether the tree stump has unevenness at its surface or was placed centrally in the holding device. The wedging motion takes place sufficiently strongly so that the tree stands firmly in its vertical alignment.

To remove the tree, the foot lever 20 is raised by foot counter to the tensioning and stepping direction. By these means, the locking mechanism at the tensioning device 2 can be released, as a result of which the roller 21, with the wound-up force-transfer elements 3, which preferably is in the form of a wire rope, is released. By these means, in turn, the sliding or carriage elements 10 to 10*c*, together with the holding elements 4 to 4*c* pivotably fastened to them, can be moved back into their idle position by means of the retraction springs 13, 13*a*, 13*b* and 13*c*, in order to remove the tree free. In FIGS. 1 and 2, the retraction springs 13 to 13*c* have been drawn, which are fastened, on the one hand, to the sliding elements or carriages 10 to 10*c* and, on the other hand, externally to a fastening site 13' at the outer periphery of the holding device. After this retraction movement, the tree can then once again be removed.

In order to permit the holding elements 4 to 4*c* to swivel during the transport above that pivot axes 14 to 14*c* at about the same height as the covering hood 5 in the direction of the imaginary central plane or the plane of symmetry 115, bulges 17, 17*a*, 17*b* and 17*c* are formed in the tunnel 16' without affecting the leakproofness of the latter, in order to make it possible for the holding elements 19 to be swiveled from their locking position, shown in FIGS. 1 and 2, into their approximately horizontally extending transporting position.

One or more pointed arbors 19, connected with the base, can be used for additionally fixing the lowest legion of the material or tree, which is to be inserted, but are not absolutely necessary, because of the special arrangement and shaping of the holding elements 4 to 4*c*, since the latter engage the material to be held with their contacting surfaces or points, lying vertically above one another and at a distance from one another. Said arbors interfere especially when a rod-shaped material, which is particularly hard material or even a non-deformable material such as iron, etc. is to be centered.

In the following, reference is made to a modified embodiment of FIG. 3. In the case of this embodiment, webs 6, 6*a*, 6*b* and 6*c*, corresponding to plate 6, are provided. On the one hand, they are external and connected with the outer wall 1*a*, which usually is cylindrical, and extend from this, in the example shown, approximately horizontally towards the inside and, with their offset angle 6', 6'*a*, 6'*b*, 6'*c*, are connected with the base 1 of the accommodating vessel. By these means also, a sort of tunnel or cavity 16' is formed, which is suitable for an accommodating element 15 for increasing the weight. This element 15 may be one, which is disposed, for example, in the tunnel or cavity 16', which extends in annular fashion in plan view. This element 15 may be hollow in the interior and filled, for example, with a liquid or sand. As in the preceding example, the slide rails 8 to 8*c*, which are disposed parallel to the base 1 of the accommodating vessel 1*a*, are provided once again on the upper side of the web.

To this extent, reference is made to the description of the preceding example.

In the case of this example also, the holding elements 4 to 4*c* can be changed over into a horizontal position during the transport, so that they are approximately at the level of their pivot axes 14 to 14*c*. In order to permit this swiveling motion of the contacting surfaces or points, lying at the top, in the direction of the central axis or axis of symmetry 115, recesses 7, 7*a*, 7*b*, 7*c*, in which the lower past of the pivotable holding elements carries out the swiveling motion, are provided in the webs 6 to 6*c*, which have been mentioned. Accordingly, this recess has the same function, which was explained already by means of the first example.

A new tensioning device, the rope roller 21 of which is disposed lengthwise from the axis of symmetry to the outer wall 1*a*, is described by means of FIGS. 4 and 5. By means of a ring seal 34, this arrangement permits the interior space to be sealed completely in an appropriate shaping 33 at the inside of the housing, so that, when appropriate materials are used, the inside of the housing can be filled completely for watering tree trunks with water. The shoulder of the drive shaft 26 protrudes out of the housing and the drive shaft 26, which may also be a pipe, is passed through the interior of the rope roller 21. The shoulder of the drive shaft is connected with a relatively long foot lever 20, which fulfills its purpose with the expenditure of comparatively little force. Furthermore, the force transfer elements 3 do not require any diversions in order to be the wound up properly by the rope roller 21, since they are guided to these in their natural course.

The rope roller 21, which is made from a pipe and mounted rotatably, on the one hand, in a bearing 33 in the side walls of the housing parts 1, 5 and, on the other, in a bearing block 21, has, after it is mounted 31 in the interior of the housing of the stand, a gear wheel 25, which is firmly connected with it. The drive shaft 26, which is passed through the interior of the rope roller 21, has, at its side protruding from the housing 1, 5, a foot lever 20 and, at its interior side, protruding beyond the rope roller 21, a catch 22 is fastened. When the foot lever 20 is actuated in the direction of the base, the drive shaft 26, which is detachably connected with it, and the catch 22, which is connected with it at the opposite side, are caused to rotate. By means of the catch plate 23, which is pivotably fastened to the upper end of the catch 22 and pushed by a compression spring 24 with it downward pointing edge against the indentations of the gear wheel 25, the gear wheel 25 and, with it, the rope roller 21 are rotated so that the force transfer element 3, fastened with its ends to the rope roller 21, is wound up. Due to the tension of the force transfer element 3, which is passed through the boreholes in the sliding elements 10, 10*a*, 10*b*, 10*c*, to which the holding elements 4, 4*a*, 4*b*, 4*c* are pivotably fastened, the latter are pulled with their holding regions against the tree stump.

In order to prevent an intentional turning back of the rope roller, a check plate 28, which is pressed by means of a compression spring 29 with its upward pointing edge against the indentations of the gear wheel 25, is provided at the bearing block 31. In order to be able to repeat this process frequently, the foot lever 20, the drive shaft 26 and the catch 22 connected with the latter, are moved after each release into the starting position by means of a retracting spring 35 attached to the catch 22.

For disconnecting the force transfer elements 3 and, with that, the holding elements 4, 4*a*, 4*b*, 4*c*, the foot lever 20 is pressed upward opposite to the stepping direction, as a result of which the drive shaft 26 and the catch, 22, connected with the latter, move counter to the fastening direction of rotation. At its downwardly pointing side, the catch 22 is shaped so that the check plate 28, during the rearward movement, is forced out of the indentations of the gear wheel 25. At the same time, the catch plate 23 is pressed against an arbor 27, which is connected with the bearing block, so that this catch plate 23 is pushed out of the indentations of the gear wheel 25, thus releasing the rope roller 21.

The force transfer element 3 is thus slackened of at its ends and the retraction springs 13, 13*a*, 13*b*, 13*c* can move the sliding elements 10, 10*a*, 10*b*, 10*c* and, with that, the holding elements 4, 4*a*, 4*b*, 4*c* into their release position and, with that, release the tree stump.

In order to be able to fill the whole of the interior with watering water, it is necessary to provide appropriate seals. When a pipe is used as drive shaft 26, this can be accomplished essentially by means of a stopper 37, which must be applied at the end of the shaft. Furthermore, a sealing ring 30 is used on the drive shaft 26 within the rope roller 21 and a radial shaft seal 34 is used, which seals the drive shaft 26 from the housing.

Shifting of the rope roller 21 and of the drive shaft 26 is prevented, on the one hand, by the foot lever 20, which is detachably fastened outside, and, on the other, by a locking plate, which, together with the bearing block 31, is connected detachably (for example, by means of screws) with the base 1.

In the following, reference is made to the example of FIGS. 6 and 7, which differs from the preceding examples essentially owing to the fact that sliding or carriage elements or rolling devices, which are comparable in their action therewith, are not provided for the radial adjustment of the holding elements, which can be swiveled about a horizontal tilting axis. Instead, the holding elements can be adjusted with their horizontal tilting axis about movably mounted tilting levers.

In this example, a holding device is shown with a base plate 1, which is connected over the whole of its periphery with a wall, which is disposed perpendicularly to the base plate 1 and forms a container. Several bearing supports 106, 106*c*, 106*b*, 106*d*, consisting of a spaced-apart pair of plates, are connected about an adjustment space 116 with the base plate 1, so that pivoted levers 105, 105*a*, 105*b*, 105*c*, can be swiveled. For this purpose, the bearing supports are constructed U-shaped in cross section by the bearing bolt 108, so that they can be fastened with their base plate on the base of the container. The pivoted levers 105 to 105*c* are also configured from double, pivoted levers, which are U-shaped in cross section in the form of spaced-apart pairs of levers, which are disposed parallel to one another. The pivoted levers, moreover, are mounted pivotably at the aforementioned bearing bolts preferably at their ends adjacent to the base plate 1.

At the free and usually upper end of the pivoted levers 105 to 105*c*, lying opposite the bearing bolts 108 to 108*c*, at bearing bolts 107, 107*a*, 107*b*, 107*c*, which are provided there and extend between the respective pair of pivoted levers 105, holding elements 104, 104*a*, 104*b*, 104*c* are also mounted pivotably and, moreover, so that they point with their front side or their working surfaces 161*a* and 161*b*, which are constructed for holding, to the imaginary central axis and/or axis of symmetry 115. The aforementioned central axis or axis of symmetry 115 can be understood to be an axial extension of the conically shaped centering arbor 115, which is provided centrally in the base plate 1 and preferably is connected with the base plate 1. The holding levers 104 are disposed pivotably between the respective pair of pivoted levers.

For transferring the holding elements 104, 104*a*, 104*b*, 104*c* from their release position into a holding position, a tensioning device 102 is provided, which acts over force-transfer elements 103 on the individual pivoted levers 105, 105*a*, 105*b*, 105*c* and, accordingly, on the holding elements 104, 104*a*, 104*b*, 104*c*, with which these are pivotably connected. In the example of FIGS. 6 and 7, the tensioning device 102 has a latch device with a rope roller 113, which points, on the one hand, to the vertically disposed wall 1*a* of the base plate 1 and, on the other, to the imaginary axis of symmetry 115. This latch device, when caused to rotate by means of the foot lever 114, blocks counter to the direction of rotation. In the example of FIG. 6 or 7 a generally known, so-called ratchet is used, the actuating lever 114*a* of which protrudes to the outside over the peripheral edge of the base plate 1 at an angle of about 90° and which is sealed at its outlet with a rubber sleeve.

A flexible force transfer element 103, for example, a steel rope, is fastened at its one end to the rope roller 113 and, starting from there, is guided through appropriately dimensioned boreholes in the rope guides 118, 117 and boreholes 104, 104*a*, 104*b*, 109*c* in the pivoted levers 105, 105*a*, 105*b*, 105*c*, as well as in the rope guides 117 and 118, in order to fasten the opposite end of the steel rope 103 also at the rope roller 103, or at a fixed point in front of the rope roller 113.

As long as the force transfer element 103 is not tensioned by the tensioning device 102, that is, as long as it is slack, the pivoted levers 105, 105*a*, 105*b*, 105*c* are pre-stressed by the retraction springs 110, 110*a*, 110*b*, 110*c* in the direction of their release position, the springs 110 to 110*c* being supported at supports 111 to 111*c* at the inside of the outer wall 1*a*.

The mode of the functioning of the Christmas tree stand, described so far, is as follows.

The Christmas tree is placed with the free end of its trunk approximately centrally between the contacting regions of the holding elements 104, 104*a*, 104*b*, 104*c* on the centering arbor 115, by means of which a first fixing of the position of the trunk in the horizontal direction takes place. An apparently vertical alignment by hand follows, after which the foot lever 114, 114*a* is actuated with one foot, as a result of which the rope roller 113, which has been caused to rotate, rolls up the force-transfer element 103 and, by means of the successively shortened length of the steel rope 103, moves the pivoted levers 105, 105*a*, 105*b*, 105*c* against the force of the helical tension springs 110, 110*a*, 110*b*, 110*c* about their pivoted axes 108, 108*a*, 108*b*, 108*c* and, with them, the holding elements 104, 104*a*, 104*b*, 104*c*, pivotably mounted at them on bearing bolts 107, 107*a*, 107*b*, 107*c* above and below these towards the imaginary axis of symmetry or to the tree stump, and places the holding regions, independently of the external shape of the tree stump or whether the latter was inserted centrally, essentially simultaneously or consecutively against the tree stump and wedge the latter, so that, when it is aligned vertically, it stands firmly.

For removing the tree, the foot lever 114, 114*a* is raised by foot in the opposite direction to the tension or stepping direction. The thereby released locking device and the tensioning device 102 releases the roller 113 with the wound-up rope 103, as a result of which the pivoted levers 105, 105*a*, 105*b*, 105*c* with the holding elements 104, 104*a*, 104*b*, 104*c* fastened thereto are moved into their starting position 110, 110*a*, 110*b*, 110*c* by means of the retraction springs. The tree can be removed.

By means of FIGS. 8 to 11, an example, modified from the previous ones, is explained, for which the force transfer element 103, which is constructed preferably in the form of a wire rope and starts out from the tensioning device 102, is not constructed as a closed loop for actuating the swiveling elements and, with that, finally the holding elements, but is divided, the ends of the force transfer elements 103, which preferably come to lie opposite the tensioning device 102, being supported and anchored at a supporting device 190. At the same time, the ends of the rope loops 103 are also not supported rigidly at this supporting place 190, but are passed through a borehole 192 in a rope guide 191 and provided with a stop element 193, which is anchored at the end of the rope guide and which, when subjected to pressure, cannot be moved through the borehole in the rope guiding element. Between this stop element 193 and the rope guide, a spring-force storage device 195 is provided, preferably in the form of a coil spring, which embraces an appropriate section of the wire rope.

Whereas, in the case of the example of FIGS. 6 and 7, the whole of the tensioning device is disposed within the accommodating vessel, so that the rope guide is not passed through any boreholes out of the accommodating vessel to the outside (for this reason, when the accommodating vessel is filled with water, there is no problem with a water-tight seal in the region of the rope feed-through), in the case of the example of FIGS. 8 to 10 provisions are made so that the force transfer device 103 is installed in the form of a wire rope over the upper edge 1' of the accommodating vessel beyond a rope guide 201, which is formed there, out of the accommodating vessel to the tensioning device. As a result, sealing measures are not required in order to prevent moisture reaching the outside through the rope feed-through when the interior space is filled with water. Moreover, it can also be seen from FIGS. 8 and 10 that an appropriate indentation 203 is provided at the otherwise cylindrically shaped boundary edge la of the container wall, in order to create sufficient space for the tensioning device 102.

Furthermore, by means of FIG. 11, examples of the adjusting movement of the pivoted lever 105 and of the holding elements, carried by the pivoted lever 105, are shown. The swiveling motion of the pivoted levers 105 about the pivot axes 108, which are located at the bottom and, as a rule, are horizontal, contributes to the fact that the crankshaft journals or, as a rule, horizontal tilting axes 107 of the holding levers 104 are swiveled continuously on a circular path not only in the direction of the central axis or axis of symmetry 115, but also with a component in the downward direction. Due to this movement, the holding elements 104 are adjusted additionally towards the base and, as a result, press the tree stump even more onto a centering arbor 119, which is provided in the interior on the base plate 1, and, as a result, fix the tree even better. Moreover, it is shown in FIG. 11 how the holding elements 104, in the case of a tree with an increasingly decreasing diameter, are shifted even more strongly and further downward to the base plate 1 of the mechanical holding device.

In the different positions, shown in FIG. 11, the holding elements can embrace and secure a tree with a diameter of, for example, 2×63 mm, 2×39 mm or 2×22 mm.

What is claimed is:

1. A holding device for holding a post-shaped object, comprising:

a stand comprising a base plate;

a plurality of holding elements disposed about an axis of symmetry or a central axis of the holding device spaced from each other in a circumferential direction and having at radially inward portions thereof engagement surfaces radially spaced from the axis of symmetry or central axis;

a tensioning device and, operatively connected thereto, a force transfer device comprising a wire or other rope or other elongated flexible element, the holding elements being adapted to be swivelled to the outside to a release position and to the inside to a fixing position in which the engagement surfaces are adapted to be in contact with the outer periphery of the post-shaped object, fixing the latter;

the holding elements together with means defining the pivot axis of each being so mounted that they can be shifted towards or away from the axis of symmetry or central axis; and means for effecting said shifting movement comprising the tensioning device and, acting counter thereto, a spring device.

2. The holding device of claim 1, wherein the means for effecting said shifting movement comprises a sliding or rolling device cooperating with the means defining each said pivot axis.

3. The holding device of claim 2, wherein the means for effecting said shifting movement comprises slide rails.

4. The holding device of claim 3, wherein the slide rails are disposed above the base plate.

5. The holding device of claim 4, further comprising a support plate which carries the slide rails and is spaced above the base plate, an annular wall on the base plate to form, with the base plate, a container, and a cavity which can be filled with a weight-increasing material being formed between the base plate, the annular wall and the support plate.

6. The holding device of claim 4 or 5, wherein the support plate is annular and the holding device further comprises a boundary wall connecting the support plate with the base plate proximate an inner periphery of the support plate.

7. The holding device of claim 5, wherein the container has free spaces permitting said shifting movement of the holding elements.

8. The holding device of claim 5, wherein the spring devices are supported at an end thereof by the container.

9. The holding device of claim 5, wherein the force transfer device is disposed entirely within the container.

10. The holding device of claim 9, wherein at least elements of the tensioning device essential for at least producing a tensioning effect on the force transfer device are disposed within the container.

11. The holding device of claim 5, wherein at least elements of the tensioning device essential at least for producing a tensioning effect on the force transfer device are disposed outside the container.

12. The holding device of claim 11, further comprising a guide for guiding the elongated flexible element over an upper edge of the annular wall to the tensioning device, the tensioning device being disposed outside the container.

13. The holding device of claim 3, wherein the slide rails have sliding slots.

14. The holding device of claim 3, further comprising means for guiding the elongated flexible element.

15. The holding device of claim 3, further comprising an annular partial cover for the container, the cover and container together comprising a housing of the holding device, the housing being comprised of at least one of plastic and metal.

16. The holding device of claim 1, wherein the means for effecting said shifting movement comprises pivotable levers cooperating with the means defining each said pivot axis.

17. The holding device of claim 1, further comprising means mounting the holding elements so that when the holding elements are swiveled from their release position into their fixing position, the holding elements also move toward the base.

18. The holding device of claim 1, wherein the tensioning device includes a rotatable drive shaft and further comprising means for sealing the drive shaft.

19. The holding device of claim 5, further comprising a roller for the elongated flexible element, the roller passing through the annular wall, and a ring seal at the opening.

20. The holding device of claim 1, further comprising an electric motor for driving the tensioning device.

21. A holding device for holding a post-shaped object, comprising:

a stand comprising a base plate;

a plurality of holding elements disposed about an axis of symmetry or a central axis of the holding device spaced from each other in a circumferential direction and having at radially inward portions thereof engagement surfaces radially spaced from the axis of symmetry or central axis;

a tensioning device and, operatively connected thereto, a force transfer device comprising a wire or rope or other elongated flexible element;

means defining a pivot axis on each holding element for pivoting said engagement surfaces about a point on the respective holding element;

at least one slot in communication with each of said plurality of holding elements for sliding said holding elements and said pivot axes to the outside to a release position and to the inside to a fixing position in which the engagement surfaces are adapted to be in contact with the outer periphery of the post-shaped object, fixing the latter; and means for effecting said shifting movement comprising the tensioning device and, acting counter thereto, a spring device.

22. A holding device for holding a post-shaped object, comprising:

a stand comprising a base plate;

a plurality of holding elements disposed about an axis of symmetry or a central axis of the holding device spaced from each other in a circumferential direction and having at radially inward portions thereof engagement surfaces radially spaced from the axis of symmetry or central axis;

a tensioning device and, operatively connected thereto, a force transfer device comprising a wire or rope or other elongated flexible element;

means defining a first pivot axis on each holding element for pivoting said engagement surfaces about a point on the respective holding element;

a second pivot axis in communication with each said holding elements for pivoting said holding elements and said pivot axes to the outside to a release position and to the inside to a fixing position in which the engagement surfaces are adapted to be in contact with the outer periphery of the post-shaped object, fixing the latter; and means for effecting said shifting movement comprising the tensioning device and, acting counter thereto, a spring device.

* * * * *